US005222765A

United States Patent [19]

Pileggi

[11] Patent Number: 5,222,765

[45] Date of Patent: Jun. 29, 1993

[54] APPARATUS FOR BINDING STATIONARY AND METHOD OF USING SAME

[76] Inventor: Joseph Pileggi, 1465 Broad St., Dresher, Pa. 19025

[21] Appl. No.: 861,105

[22] Filed: Mar. 31, 1992

[51] Int. Cl.[5] ..... B42D 3/18

[52] U.S. Cl. ..... 281/51; 402/80 R; 281/15.1; 281/44; 281/45

[58] Field of Search ..... 281/15.1, 29, 42, 43, 281/44, 45, 51; 402/80 R

[56] References Cited

U.S. PATENT DOCUMENTS

| | | | |
|---|---|---|---|
| D. 270,779 | 10/1983 | Steinberg . | |
| 3,279,008 | 10/1966 | Wallach . | |
| 3,383,738 | 5/1968 | Fox . | |
| 3,534,447 | 10/1970 | Muirhead | 402/70 X |
| 3,679,539 | 7/1972 | Perina . | |
| 3,841,648 | 10/1974 | Meyer . | |
| 3,893,725 | 7/1975 | Coulter . | |
| 4,243,249 | 1/1981 | Goss | 251/51 |
| 4,878,274 | 11/1989 | Patricy . | |
| 5,054,816 | 10/1991 | Rosengarten | 281/42 |

FOREIGN PATENT DOCUMENTS

| | | | |
|---|---|---|---|
| 292412 | 11/1988 | European Pat. Off. | 402/70 |
| 1161406 | 8/1969 | United Kingdom . | |

*Primary Examiner*—Paul A. Bell
*Attorney, Agent, or Firm*—Ferrill and Logan

[57] ABSTRACT

The present invention provides improved apparatus and method for binding stationery items, such as stacks and rolls of paper, file folders, and the like. The invention provides an elastic strip which includes hook and loop attachment means on its ends to bind to itself to form a continuous band. In the preferred embodiment, one end of the strip is provided with a Y-shaped end to form a more secure attachment. The present invention provides all the benefits of conventional rubber bands, but is easier to use and avoids many of the problems normally encountered with existing stationery binding methods.

17 Claims, 2 Drawing Sheets

APPARATUS FOR BINDING STATIONARY AND METHOD OF USING SAME

1. FIELD OF THE INVENTION

The present invention relates to devices used to bind stationery items. More specifically, it provides a new binding device which is more convenient to use and less likely to damage stationery items than presently known devices

2. DESCRIPTION OF THE PRIOR ART

Various devices for binding paper and other stationery items have been used for many years. Stationery binding devices, such as rubber bands, secure file folders to prevent papers from falling out, hold stacks of paper together for convenience of handling and maintaining document order, and hold together rolled papers such as blue prints for ease of handling and storage.

While current binding devices offer many conveniences in handling stationery items, the devices themselves can be problematic to use. Rubber bands and other such continuous flexible devices must be stretched and placed around the entire item. Where the stationery item to be bound involves a great number of pages or is quite large, rubber bands can be difficult to stretch and often fatigue and break. Tightly stretched rubber bands can also cut into the stationery being bound. Finally, rolling rubber bands on and off rolled items, such as a poster or a set of rolled blueprints, can be difficult to do and often rips the paper in the roll.

Tied string is another common stationery binder. String, however, can be difficult to tie and is not flexible like rubber to firmly bind stationery items Additionally, string is usually non-reusable since it typically must be removed by cutting.

In light of the foregoing, it is a primary object of the present invention to create a stationery binding device which is flexible like rubber to firmly bind stationery, but more convenient to use.

It is another object of the present invention to provide a binding device that is easy to install and remove without damaging the bound item.

It is a further object of the present invention to provide a binding device that can be reused.

SUMMARY OF THE INVENTION

The present invention provides a unique stationery binder which is relatively inexpensive, easy to use, and avoids damaging the bound items.

In its simplest form, the present invention provides an elongated strip of flexible material with hook and loop type fastening material at opposite ends and on opposite sides of the strip. The strip is stretched and wrapped entirely around the stationery item such that the hook and loop fastening sections come into alignment with each other. The binding is completed by pressing the hook and loop fastener section together, forming a secure connection and creating a continuous secure wrapping around the stationery item.

In the preferred embodiment of the present invention, the binding means includes a Y-shaped end on one section of an elastic band which is adapted to surround and bind to complementary attachment means on the opposite end of the elastic band. It has been found that this provides a vastly improved binding device which is extremely secure.

The present invention readily lends itself to a wide variety of uses, including as a separate unit for binding together virtually any form of stationery items, and as a component affixed to existing stationery products, such as file folders.

DETAILED DESCRIPTION OF THE INVENTION

The present invention provides an improved apparatus and method for binding together stationery items, such as stacks or rolls of paper, file folders, loose office accessories, etc.

Figure 1:
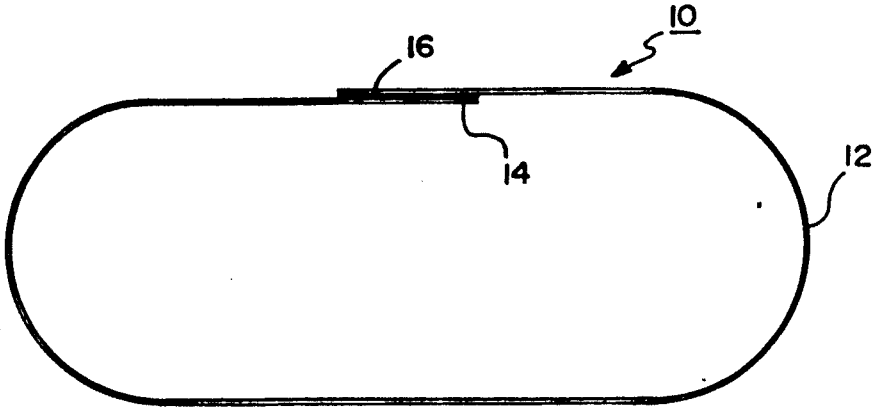
FIG. 1 is a perspective view of one embodiment of the present invention.
Figure 2:
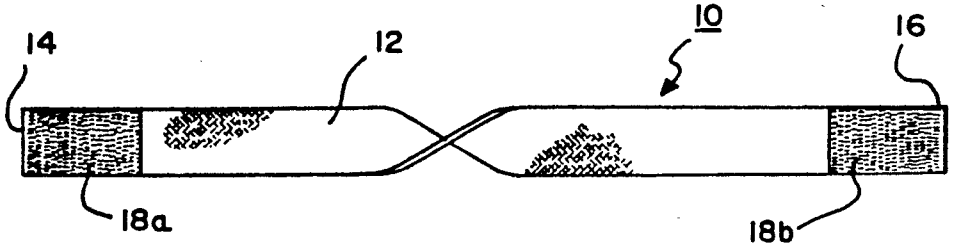
FIG. 2 is a perspective view of the embodiment shown in FIG. 1, shown twisted, to illustrate pertinent portions on the opposite ends and sides of the strip.

As shown in FIGS. 1 and 2, the present invention comprises a stationery band 10 which includes an elastic strip 12 and with ends 14 and 16. Attached to each end is complementary attachment means 18*a*, 18*b*.

The strip 12 may be constructed from rubber or any other material or fabric that is flexible and elastic. For a durable unit which may be reused, a cloth/elastic composite is preferred, such as a polyester elastic (e.g. 62% polyester, 38% rubber) manufactured by Simplicity Pentapco of Franklin, Va. The strip 12 can be manufactured in any desired length, the length being dictated by the size of the stationery items to be bound.

The width of the strip is also dictated by the particular applications desired. The width is a function of the anticipated breaking strength required, the nature of the material to be bound, and adequate area to retain the attachment means together. For use with a hook and loop attachment means, it has been found that the ends 14, 16 of the strip 12 should be approximately three (3) times the width of the strip 12 itself to provide adequate surface area for secure attachment.

For general office utility, the preferred strip comprises a length of 5" to 12" to 24" or longer, with a width of ¼" to 2". For a strip of approximately 12" length and a width of ¼", it is preferred that the area of the strip where the attachment means is attached should comprise a width of approximately ¾" to provide a more secure attachment.

The preferred attachment means 18 is hook and loop material, such as that sold under the trademark VELCRO. The hook section 18*a* is formed with a large number of relatively small hook-like elements projecting from a base surface; the loop section 18*b* is formed with matted entangled fibers forming many small loops projecting from a base surface. As is known, when the hook section 18*a* and loop section 18*b* are pressed together, the hooks become entangled with the loops such that the two surfaces are held together with a relative degree of firmness, forming a secure connection having a tremendous resistance against shear in the direction co-planar of the fastener sections. Hook section 18*a* and loop section 18*b* are easily separated from each other by peeling one section back from the other. The attachment means 18 may be affixed to the strip by any known method, including sewing, gluing, etc.

Figure 3:
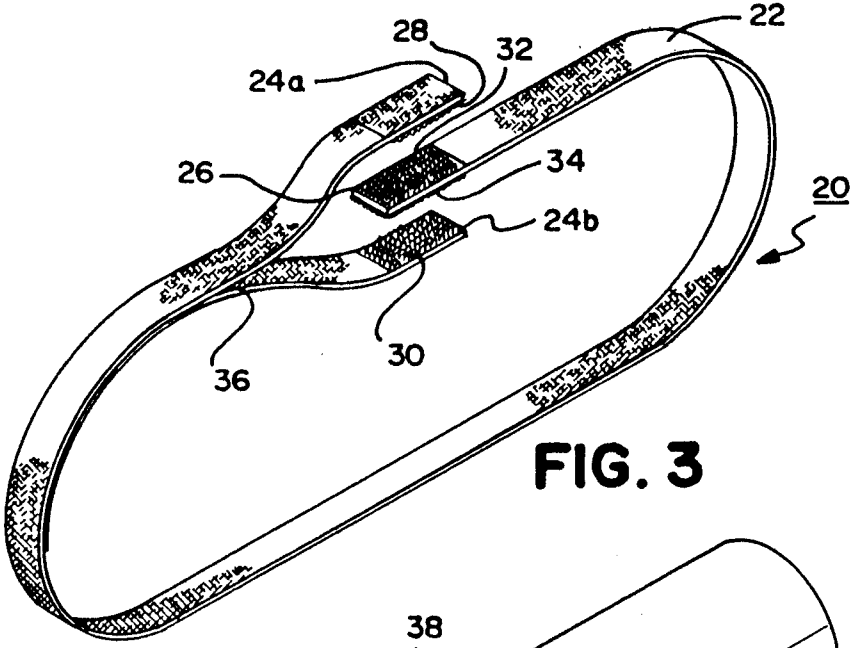
FIG. 3 is a perspective of another embodiment of the stationery band.

Another embodiment of the present invention is illustrated in FIG. 3. In this embodiment, the stationery band 20 comprises a narrow elastic strip 22 and strip ends 24 and 26. In this embodiment, the first strip end 24 is divided to form a Y-shaped unit, presenting two ends 24*a*, 24*b*.

Attached to interior faces 28, 30 of the "Y" on each of ends 24*a*, 24*b* is one portion of hook and loop fastener (i.e. either a hook or loop portion). End 26 comprises a single strip including a complementary portion of hook or loop fastener on both its faces 32, 34. By placing end 26 between each of the faces of the Y and closing each of the faces 28, 30 around it, an extremely secure attachment is achieved. The ends 24, 26 are easily separated from each other by peeling back each face 28, 30 from the corresponding end 26. The advantage of this connection over that shown in the previous embodiment is that the two sided connection can resist a greater amount of shear in a direction co-planar of the fastening sections.

The double strip ends 24*a*, 24*b* of the "Y" may be created through any suitable means, including attaching a separate segment to strip 22 along its length (e.g. by gluing, sewing, or heat welding) at joint 36, attaching a separate segment to strip 22 at its end (i.e. in a T-shape), or by molding or forming the strip 22 to include the joint in its original construction. A very strong connection may be achieved by attaching a separate segment to the strip 22 along an extended length of the strip intermediate its ends (e.g. a length equal to or greater than the length of the face 28 or 30 is affixed to the strip 22).

Figure 4:
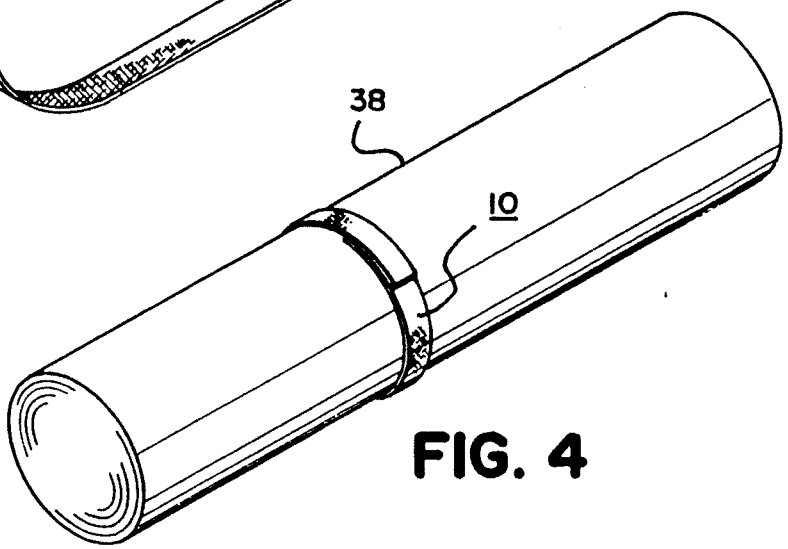
FIG. 4 is a perspective view of a roll of paper drawings bound by the present invention.
Figure 5:
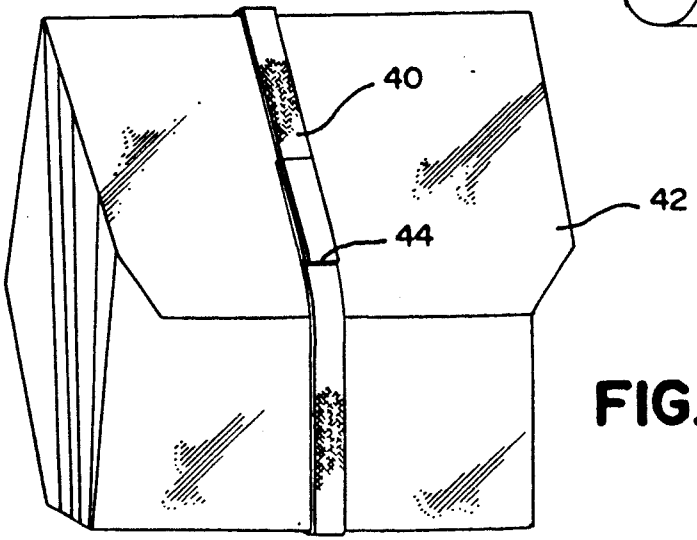
FIG. 5 is a perspective view of a file folder held closed by the present invention.

Examples of applications of the present invention are illustrated in FIGS. 4 and 5. FIG. 4 shows use of a stationery band 10 of the present invention binding a roll 38 of material, such as paper. The band 10 is wrapped around roll 38, stretched tight, and fastened in the manner described. This provides all the advantages of a conventional elastic band, but allows the stationery material to be bound together and separated without dragging the fastener along the length of the stationery material. This application lends itself equally well to bind stacks of paper and similar material.

Figure 6:
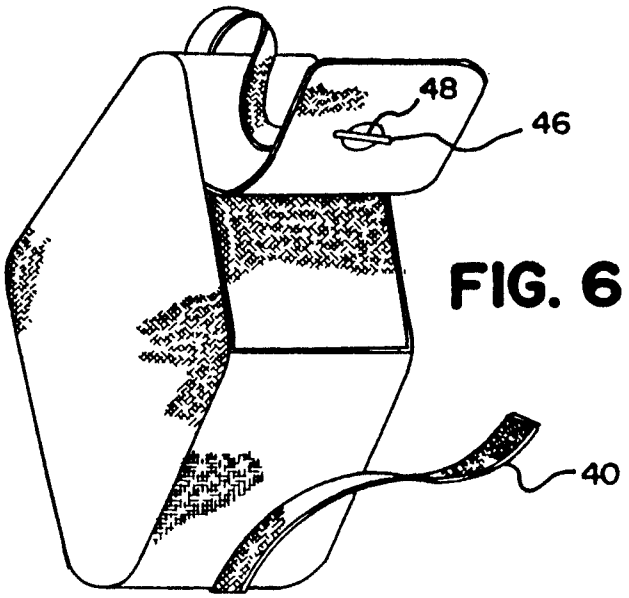
FIG. 6 is a perspective view of the band in FIG. 5.

FIGS. 5 and 6 illustrate a stationery binder 40 of the present invention used to bind a file folder 42. It is common today to apply large elastic bands to file folders to hold the contents in place. In fact, many such folders include a continuous elastic band which is permanently affixed to the folder to prevent loss. Although such use of elastic bands functions adequately well, the repeated stretching of the band onto and off of the folder causes premature fatigue of the bands and needless damage to the file folder and its contents.

By employing a band of the present invention attached to a file folder, the folder can be easily opened and closed without hyper-extending the elastic material and without wrenching the band across the file folder to open or close it. An extremely secure attachment may be achieved by using a Y-shaped closure 44, as is illustrated in FIG. 4.

The band 40 may be used separate from the folder or may be attached to the folder in any conventional method, including stapling, glue or pins. As is shown in FIG. 6, one method of attachment is to provide a bar 46 or similar device affixed to the strip 40 which may be attached to the folder through an opening 48. The band may also be attached by providing a slot (not shown) within the file folder through which the strip may be mounted.

Figure 7:
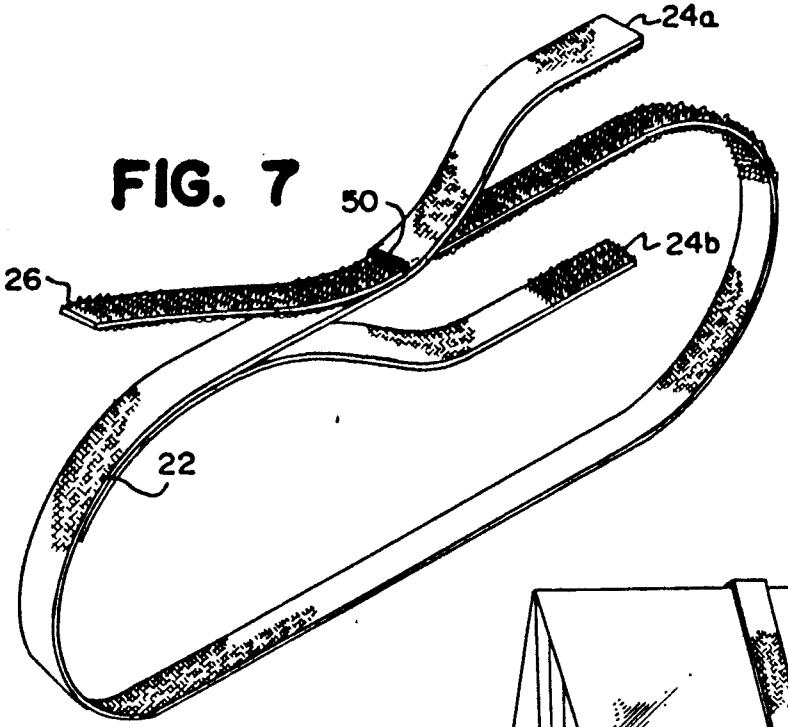
FIG. 7 is a perspective view of yet another embodiment of the present invention.

FIG. 7 illustrates a further improvement on the embodiment shown in FIG. 3. This embodiment provides the secure attachment means possible with the Y-shaped end design, but has the additional advantage of being adjustable in length. Adjustability is accomplished by providing a slot 50 in the strip 22 through which end 26 may be passed. By providing hook-and-loop material along an extended length of the strip 22 extending from end 26, a secure attachment may be achieved with a wide range of adjustability--ends 24*a* and 24*b* being closed around end 26 at whatever length is desired. As is shown, it is preferred that end 24 should be wider than end 26 to leave sufficient material surrounding slot 50 for adequate strength and durability.

It should be appreciated that the present invention may be used to bind any form of office/stationery items together, replacing rubber bands, binder clips, string, etc. In all forms of the present invention, the length of the attached strip may be adjusted by changing the location of attachment of the hook and loop means and/or by wrapping the strip multiple times around the stationery item in a manner similar to that commonly employed with conventional rubber bands to adjust their lengths.

Although particular embodiments of the present invention are disclosed herein, it is not intended to limit the invention to such a disclosure and changes and modifications may be incorporated and embodied within the scope of the following claims.

What is claimed is:

1. A band for binding stationary items comprising:

an elongated strip of flexible material;

a double strip end on one end of the strip which comprises two joined segments of flexible material and includes two interior faces;

first and second mating portions of a hook and loop-type fabric fastening material, said first mating portion being attached to both sides of one end of said strip, and the second mating portion being secured to the interior faces of the double strip end such that the second fastening material portion can enclose and fasten to both sides of the first mating portion.

2. The apparatus of claim 1 wherein the ends of the strip including attachment means are wider than the remainder of the strip to provide more surface area for secure attachment.

3. The apparatus of claim 1 wherein the band is attached to a file folder to aid in securing material within the folder.

4. The apparatus of claim 1 wherein an opening is provided in the file folder;

the band includes connecting means to pass through the opening to secure the band to the file folder; and the band is attached to the file folder by securing the connecting means within the opening.

5. The apparatus of claim 1 wherein the band comprises a continuous strip of elastic material and the joined segments are formed by attaching a separate segment of elastic material to the strip along a length of the strip intermediate its ends to form a Y-shaped double strip end.

6. The apparatus of claim 5 wherein the separate segment is bonded to the strip along the strip's length.

7. A band for binding items which comprises:

an elongated strip of flexible material having a first end and a second end, wherein the first end of the strip has a Y-shaped joint with two interior faces, and hook-and-loop-type material provided on both of the interior faces;

the second end of the strip includes complementary hook-and-loop-type material on its top and bottom surfaces; and wherein the strip is adapted to surround the items to be bound and is joined to itself by placing the second end of the strip within the two faces of the first end of the strip and fastening the hook-and-loop material.

8. The apparatus of claim 7 wherein the ends of the strip including attachment means are wider than the remainder of the strip to provide more surface area for secure attachment.

9. The apparatus of claim 7 wherein the band is attached to a file folder to aid in securing material within the folder.

10. The apparatus of claim 9 wherein an opening is provided in the file folder;

the band includes connecting means to pass through the opening to secure the band to the file folder; and the band is attached to the file folder by securing the connecting means within the opening.

11. A band for attaching items together which comprises:

a strip of flexible material having a first and second end;

a double strip end on the first end of the strip which includes two joined segments of flexible material providing two interior faces;

first and second mating portions of a hook and loop-type fabric fastening material, said first mating portion being attached to both sides of the second end of said strip, and the second mating portion being secured to the interior faces of the double strip end such that the second fastening material portion can enclose and fasten to both sides of the first mating portion.

12. The band of claim 11 wherein the ends of the strip including the hook-and-loop material are wider than the remainder of the strip to provide more surface area for secure attachment.

13. The apparatus of claim 11 wherein the band comprises a continuous strip of material and the joined segments are formed by attaching a separate segment of material along a length of the strip between its ends to form a Y-shaped double strip end.

14. The apparatus of claim 13 wherein the separate segment is bonded to the strip along the strip's length.

15. The apparatus of claim 11 wherein means are provided to adjust the length of the band.

16. The apparatus of claim 15 wherein the means to adjust the length of the band includes a slot within one of the joined segments adapted to allow the second end to pass therethrough to adjust the attached length of the band.

17. The apparatus of claim 16 wherein the second end of the strip includes an extended length of hook-and-loop material to provide a range of attachment options within the double strip end.

* * * * *